US009230529B2

(12) United States Patent
Tachimori

(10) Patent No.: US 9,230,529 B2
(45) Date of Patent: Jan. 5, 2016

(54) MUSIC REPRODUCING APPARATUS

(71) Applicant: Onkyo Corporation, Osaka (JP)

(72) Inventor: Nobuya Tachimori, Osaka (JP)

(73) Assignee: Onkyo Corporation, Neyagawa-shi (JP)

( * ) Notice: Subject to any disclaimer, the term of this patent is extended or adjusted under 35 U.S.C. 154(b) by 57 days.

(21) Appl. No.: 14/513,700

(22) Filed: Oct. 14, 2014

(65) Prior Publication Data

US 2015/0107442 A1 Apr. 23, 2015

(30) Foreign Application Priority Data

Oct. 18, 2013 (JP) ..... 2013-217696

(51) Int. Cl.
*G10L 19/00* (2013.01)
*G10H 7/00* (2006.01)

(52) U.S. Cl.
CPC ..... *G10H 7/002* (2013.01); *G10L 19/00* (2013.01); *G10H 2230/015* (2013.01); *G10H 2250/035* (2013.01)

(58) Field of Classification Search
USPC ..... 84/602; 700/94; 704/500
IPC . G10H 7/002,2230/015, 2250/035; G10L 19/00
See application file for complete search history.

(56) References Cited

U.S. PATENT DOCUMENTS 4,644,400 A * 2/1987 Kouyama et al. ..... 348/512
5,168,363 A * 12/1992 Kojima et al. ..... 348/704
5,177,801 A * 1/1993 Shoda et al. ..... 381/119
5,803,747 A * 9/1998 Sone et al. ..... 434/307 A
6,362,764 B1 * 3/2002 Niimi et al. ..... 341/144
7,292,902 B2 * 11/2007 Smithers et al. ..... 700/94
7,302,396 B1 * 11/2007 Cooke ..... 704/500
7,933,422 B2 * 4/2011 Okabayashi ..... 381/119
8,423,852 B2 * 4/2013 Garudadri et al. ..... 714/747
8,473,084 B2 * 6/2013 Lindahl et al. ..... 700/94

(Continued)

FOREIGN PATENT DOCUMENTS

JP 09-282800 10/1997
JP 2005-044409 2/2005

(Continued)

OTHER PUBLICATIONS

Japanese Decision to Grant with translation to corresponding Japanese Application No. 2013-217696 mailed Mar. 24, 2015.

(Continued)

*Primary Examiner* — David Warren
(74) *Attorney, Agent, or Firm* — Renner, Otto, Boisselle & Sklar, LLP

(57) ABSTRACT

In a music reproducing apparatus for converting audio data into audio data of different data format so as to reproduce it, gapless reproduction and cross-fade reproduction are performed in a switching manner, and generation of a noise at time of the gapless reproduction is repressed. When a reproducing section performs the gapless reproduction, a converting section performs conversion into PCM data to be reproduced latterly using a buffer used for conversion into the PCM data to be reproduced formerly. Further, when the reproducing section performs the cross-fade reproduction, the converting section generates a buffer different from the buffer used for the conversion into the PCM data to be reproduced formerly in a storage section, and performs the conversion into the PCM data to be reproduced latterly using the generated buffer.

5 Claims, 6 Drawing Sheets

(56) References Cited

U.S. PATENT DOCUMENTS

| | | | | |
|---|---|---|---|---|
| 8,805,693 | B2 * | 8/2014 | Lindahl et al. | 704/500 |
| 8,904,453 | B2 * | 12/2014 | Stewart et al. | 725/87 |
| 2002/0133357 | A1 * | 9/2002 | McLean | 704/500 |
| 2005/0016364 | A1 | 1/2005 | Kamiya | |
| 2009/0083047 | A1 * | 3/2009 | Lindahl et al. | 704/504 |
| 2010/0063825 | A1 * | 3/2010 | Williams et al. | 704/500 |
| 2010/0208901 | A1 | 8/2010 | Kawakami et al. | |
| 2015/0107442 | A1 * | 4/2015 | Tachimori | 84/609 |

FOREIGN PATENT DOCUMENTS

| | | |
|---|---|---|
| JP | 2007-179604 | 7/2007 |
| JP | 2009-163192 | 7/2009 |
| WO | WO 2009/104402 A1 | 8/2009 |

OTHER PUBLICATIONS

Japanese Office Action with translation to corresponding Japanese Application No. 2013-217696 mailed Jan. 20, 2015.

* cited by examiner

Fig. 4

(a)

| DATA TYPE | SAMPLING FREQUENCY |
|---|---|
| DSD DATA | Fa |

(b)

| DATA TYPE | SAMPLING FREQUENCY |
|---|---|
| DSD DATA | Fb |

(c)

| DATA TYPE | SAMPLING FREQUENCY |
|---|---|
| PCM DATA | Fc |

MUSIC REPRODUCING APPARATUS

BACKGROUND OF THE INVENTION

1. Field of the Invention

The present invention relates to a music reproducing apparatus.

2. Description of the Related Art

A music reproducing program that allows a smartphone or a tablet PC to function as a music reproducing apparatus is present. The mainstream of audio data to be reproduced by the music reproducing apparatus is PCM data that is encoded by a PCM (Pulse Code Modulation) system in which a sampling frequency is 44.1 kHz and the number of quantum bits is 16 bits. In recent years, there have been DSD data that is encoded by a 1-bit DSD (Direct Stream Digital) system in which a sampling frequency is 2.8224 MHz (=44.1 kHz×64) as audio data. However, since a lot of smartphones that function as the music reproducing apparatus cannot directly reproduce DSD data, the music reproducing program occasionally allows the smartphones to convert DSD data into PCM data and reproduce the PCM data. The DSD data is converted into the PCM data by a low-pass filter process for converting DSD data into multi-bit PCM data of high sampling frequency (2.8224 MHz), and a thinning process for thinning out the multi-bit PCM data of high sampling frequency into PCM data of low sampling frequency (44.1 kHz). In the low-pass filter process, a buffer is generated for data delay.

JP 2007-179604 A discloses an apparatus for performing gapless reproduction for reproducing two audio data sequentially and seamlessly so that a soundless portion is not generated between an audio caused by the audio data to be reproduced formerly and an audio caused by the audio data to be reproduced latterly. Further, JP 9-282800 A discloses an apparatus for performing cross-fade reproduction for reproducing two audio data while performing fade-out and fade-in so that while an audio of the audio data to be reproduced formerly is being faded out, an audio of the audio data to be reproduced latterly is faded in.

In smartphones that cannot reproduce the above DSD data, DSD data should be converted into PCM data also in the gapless reproduction and the cross-fade reproduction. When the gapless reproduction is performed, a conventional music reproducing program generates a new buffer at the time of converting the audio data to be reproduced latterly separately from the buffer generated at the time of converting the audio data to be reproduced formerly. For this reason, a noise is generated between the audio of the audio data to be reproduced formerly and the audio of the audio data to be reproduced latterly at the time of the gapless reproduction.

SUMMARY OF THE INVENTION

It is an object of the present invention to enable gapless reproduction and cross-fade reproduction to be performed in a switching manner and to repress generation of noises at the time of the gapless reproduction in a music reproducing apparatus for converting audio data into audio data of different data format so as to reproduce it.

A music reproducing apparatus for performing gapless reproduction for reproducing two audio data sequentially and seamlessly and cross-fade reproduction for reproducing two audio data while performing fade-in and fade-out, the apparatus comprising: a converting section for generating a buffer in a storage section, and converting first audio data into second audio data of different data format using the generated buffer; and a reproducing section for performing the gapless reproduction and the cross-fade reproduction on the second audio data, wherein the converting section performs conversion into the second audio data to be reproduced latterly using the buffer used for the conversion into the second audio data to be reproduced formerly when the reproducing section performs the gapless reproduction, generates a buffer different from the buffer used for the conversion into the second audio data to be reproduced formerly in the storage section, and performs the conversion into the second audio data to be produced latterly using the generated buffer when the reproducing section performs the cross-fade reproduction.

In the present invention, when the gapless reproduction is performed, conversion into second audio data to be reproduced latterly is performed by using a buffer used at the time of conversion into second audio data to be reproduced formerly. Therefore, separately from the buffer generated at the time of the conversion into the second audio data to be reproduced formerly, a new buffer is not generated at the time of the conversion into the second audio data to be reproduced latterly. For this reason, the generation of noises is repressed between the audio of the audio data to be reproduced formerly and the audio of the audio data to be reproduced latterly at the time of the gapless reproduction. Further, when the cross-fade reproduction is performed, a buffer different from the buffer used for the conversion into the second audio data to be reproduced formerly is generated, and the conversion into the second audio data to be reproduced latterly is performed by using the generated buffer. For this reason, in the music reproducing apparatus that converts audio data into audio data having a different data format so as to reproduce it, use of a single buffer and generation of a plurality of buffers are switched, so that the gapless reproduction and the cross-fade reproduction can be performed in a switching manner.

Preferably, wherein the converting section stores a sampling frequency of the first audio data converted into the second audio data in the storage section, when the sampling frequency stored in the storage section is different from the sampling frequency of the first audio data converted into the second audio data, generates a buffer that is different from the buffer used for the conversion into the second audio data to be reproduced formerly in the storage section even in a case where the reproducing section performs the gapless reproduction, and performs the conversion into the second audio data to be reproduced latterly using the generated buffer.

When a sampling frequency of first audio data converted into the second audio data formerly is different from a sampling frequency of first audio data converted into the second audio data latterly, the conversion into the second audio data to be reproduced latterly cannot be performed by using the buffer used for the conversion of the second audio data to be reproduced formerly. In the present invention, when the sampling frequency of the first audio data converted into the second audio data formerly is different from the sampling frequency of the first audio data converted into the second audio data latterly, a buffer different from the buffer used for the conversion of the second audio data to be reproduced formerly is generated even at the gapless reproduction, and the conversion into the second audio data to be reproduced latterly is performed by using the generated buffer. For this reason, even when the sampling frequencies of both the former and latter first audio data are different from each other, the first audio data is converted into the second audio data, so that the gapless reproduction can be performed.

Preferably, wherein when the converting section does not perform the conversion into the second audio data to be reproduced formerly, the converting section generates a buffer in the storage section even in the case where the reproducing section performs the gapless reproduction, and performs the conversion into the second audio data to be reproduced latterly using the generated buffer.

When the conversion into the second audio data to be reproduced formerly is not performed, a buffer is not generated in a storage section. For this reason, the conversion into the second audio data to be reproduced latterly cannot be performed by using the buffer. In the present invention, when the conversion into the second audio data to be reproduced formerly is not performed, a buffer is generated even at the gapless reproduction, and the conversion into the second audio data to be reproduced latterly is performed by using the generated buffer. For this reason, even when the conversion into the second audio data to be reproduced formerly is not performed, the first audio data is converted into the second audio data so that the gapless reproduction can be performed.

Preferably, wherein the first audio data is DSD data, the second audio data is PCM data.

In the present invention, the DSD data is converted into the PCM data, and the gapless reproduction and the cross-fade reproduction of the converted PCM data can be performed.

A storage medium in which a music reproducing program is stored, the music reproducing program allows a computer to function as a music reproducing apparatus for performing gapless reproduction for reproducing two audio data sequentially and seamlessly and cross-fade reproduction for reproducing two audio data while performing fade-in and fade-out, the program allowing the computer to function as: a converting section for generating a buffer in a storage section, and converting first audio data into second audio data of different data format using the generated buffer; and a reproducing section for performing the gapless reproduction and the cross-fade reproduction on the second audio data, the converting section performs conversion into the second audio data to be reproduced latterly using the buffer used for the conversion into the second audio data to be reproduced formerly when the reproducing section performs the gapless reproduction, generates a buffer different from the buffer used for the conversion into the second audio data to be reproduced formerly in the storage section, and performs the conversion into the second audio data to be reproduced latterly using the generated buffer when the reproducing section performs the cross-fade reproduction.

BRIEF DESCRIPTION OF THE DRAWINGS

FIGS. 4(*a*) to 4(*c*) illustrate one example of a table where information about audio data is stored;

DETAILED DESCRIPTION OF THE PREFERRED EMBODIMENT

Figure 1:
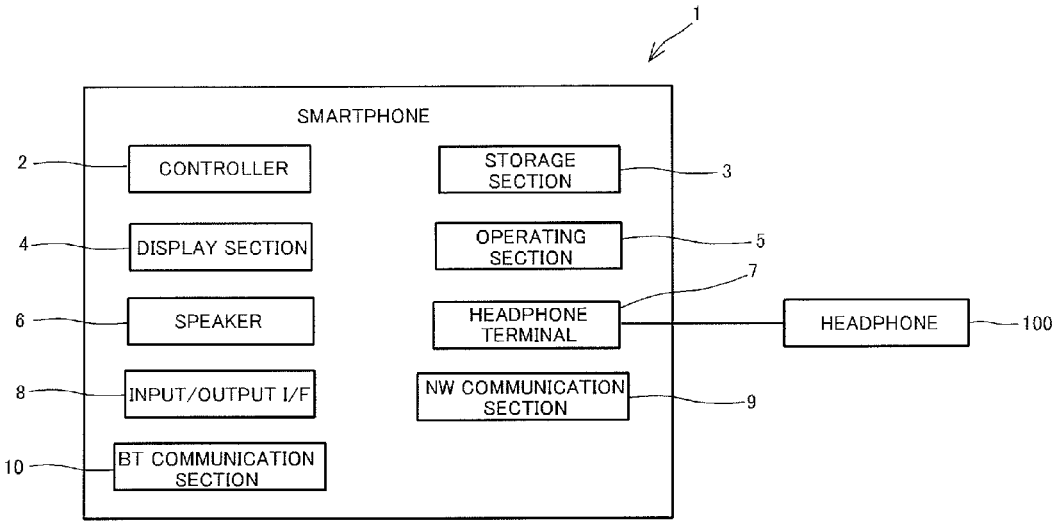
FIG. 1 is a block diagram illustrating a constitution of a smartphone according to an embodiment of the present invention.

An embodiment of the present invention is described below. FIG. 1 is a block diagram illustrating a constitution of a smartphone according to an embodiment of the present invention. A smartphone 1 functions as a music reproducing apparatus that reproduces audio data according to execution of a music reproducing program stored in a storage section 3. As shown in FIG. 1, the smartphone 1 includes a controller 2, the storage section 3, a display section 4, an operating section 5, a speaker 6, a headphone terminal 7, an input/output interface (hereinafter, "input/output I/F") 8, a network communication section (hereinafter, "NW communication section") 9, and a Bluetooth (registered trademark) communication section (hereinafter, "BT communication section") 10. The smartphone 1 performs gapless reproduction for reproducing two audio data sequentially and seamlessly, and cross-fade reproduction for reproducing two audio data while performing fade-out and fade-in according to the execution of the music reproducing program. The music reproducing program may be stored in the storage section 3 of the smartphone 1 at factory shipment, or may be downloaded from a server, not shown, via the NW communication section 9, described later, and stored in the storage section 3 of the smartphone 1.

The controller 2 controls respective sections composing the smartphone 1 according to an OS (Operating System) program or an application program, and functions as a reproducing section 24 (see FIG. 2), described later, and the like. The respective function sections such as the reproducing section 24 may be constituted by an electronic circuit specialized for an arithmetic process in the respective function sections, or may have another constitution. The controller 2 is described latterly.

The storage section 3 is composed of a RAM (Random Access Memory) that functions as a main memory of the controller 2, a ROM (Read Only Memory) for storing a control program, and a flash memory for storing programs such as application programs including an OS program and the music reproducing program, and various data such as audio data. The storage section 3 is not limited to the illustrated constitution, and may include an HDD (Hard Disk Drive).

The display section 4 displays various images (includes still images and moving images), and is composed of a liquid crystal panel. The operating section 5 has operation keys for performing various settings, and a touch panel that is linked with the display section 4. A user can input various characters such as telephone numbers and mail addresses and set communication via the operating section 5. The speaker 6 outputs various audios such as music based on audio signals output from the controller 2. The headphone terminal 7 is for connecting a headphone 100. The controller 2 outputs an audio signal to the headphone 100 via the headphone terminal 7. The input/output I/F 8 functions as an interface for data communication between the smartphone 1 and a peripheral device, not shown. The NW communication section 9 can be connected to an internet via a mobile phone network and a mobile phone base station, not shown. The smartphone 1 can telephone and communicate with another terminal via the NW communication section 9. The BT communication section 10 wirelessly communicates with a peripheral device, not shown, that supports the Bluetooth standards based on the Bluetooth standards.

Figure 2:
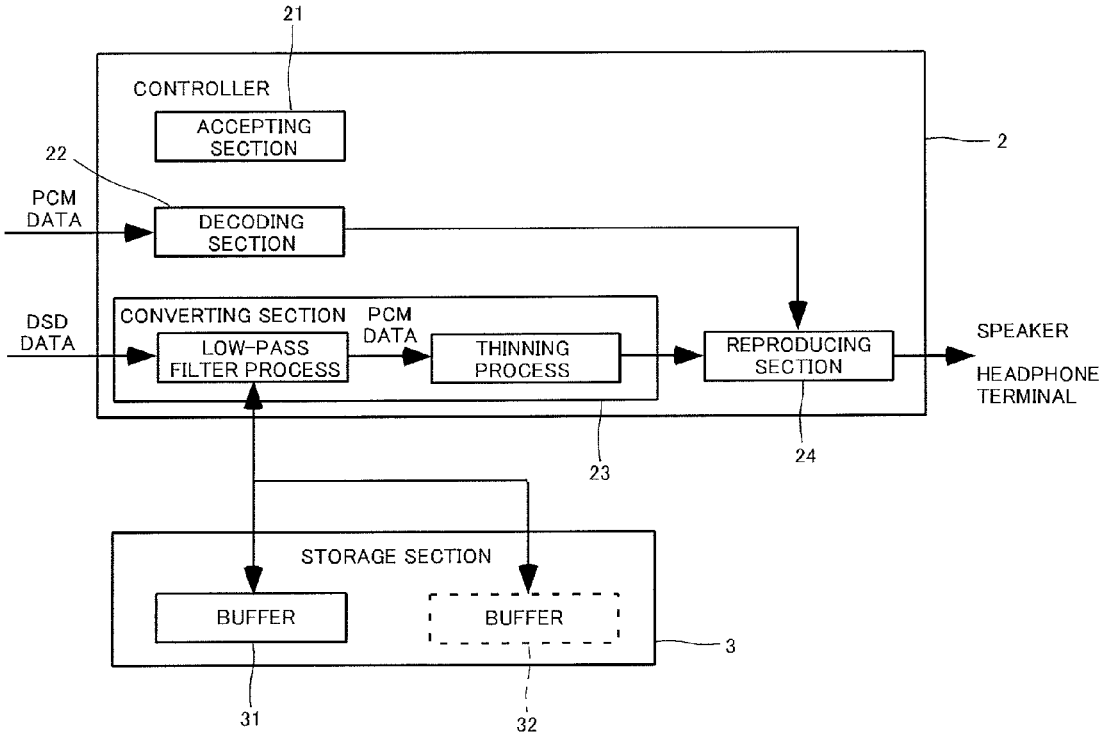
FIG. 2 is a block diagram illustrating a constitution of a controller.
Figure 3:
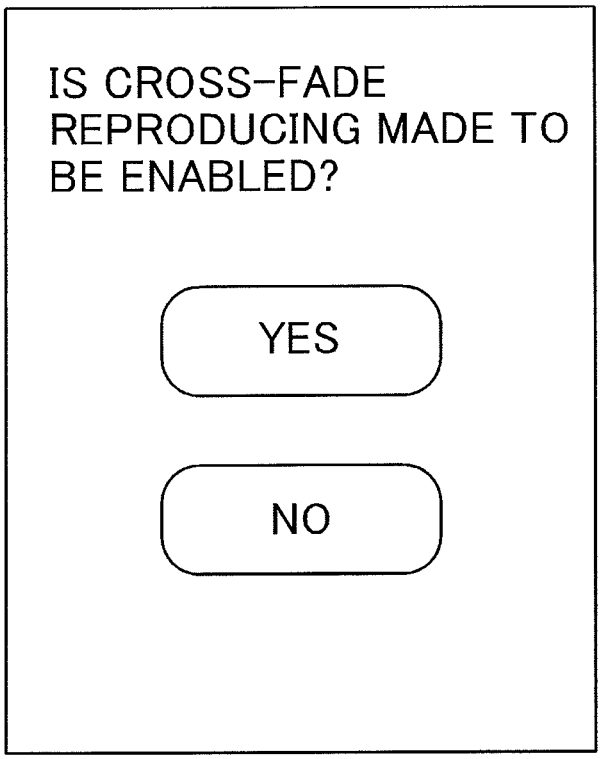
FIG. 3 is a diagram illustrating one example of information about whether cross-fade reproduction to be displayed on a display section is enabled.

The controller 2 is described below. As shown in FIG. 2, the controller 2 functions as an accepting section 21, a decoding section 22, a converting section 23, and a reproducing section 24. The accepting section 21 accepts selection whether the cross-fade reproduction is enabled. The accepting section 21 displays the information representing whether the cross-fade reproduction is enabled on the display section 4 as shown in FIG. 3, for example. The user touches the display section 4 so as to selectively enable or disable the cross-fade reproduction.

When the display section 4 is touched by the user, the accepting section 21 accepts the selection of information displayed on a touched region. For example, when a region indicating "Yes" is touched, the accepting section 21 accepts the selection of the enabling of the cross-fade reproduction. Further, for example, when a region indicating "No" is touched, the accepting section 21 accepts the selection of the disabling of the cross-fade reproduction. The accepting section 21 stores information about the accepted selection (the cross-fade reproduction is enabled or the cross-fade reproduction is disabled) in the storage section 3. In this embodiment, when the cross-fade reproduction is disabled, the reproducing section 24, described later, performs the gapless reproduction. That is to say, the reception of the selection of the disabling of the cross-fade reproduction is equal to the reception of the selection of the gapless reproduction.

When audio data to be reproduced is PCM data, the decoding section 22 decodes the PCM data. When the audio data to be reproduced is DSD data, the converting section 23 converts the DSD data (first audio data) into PCM data (second audio data) of a different data format. Concretely, the converting section 23 executes a low-pass filter process for converting the DSD data into multi-bit PCM data of a high sampling frequency (for example, 2.8224 MHz), and a thinning process for thinning out the multi-bit PCM data of high sampling frequency into PCM data of low sampling frequency (in this embodiment, 44.1 kHz), so as to convert the DSD data into PCM data. The converting section 23 generates buffers 31 and 32 in the storage section 3 as needed in the low-pass filter process. The sampling frequency of the multi-bit PCM data generated by the low-pass filter process depends on the sampling frequency of the DSD data.

In this embodiment, as shown in FIG. 4, a type of audio data to be converted by the converting section 23 (DSD data) and its sampling frequency (for example, Fa and Fb), and a type of the audio data to be decoded by the decoding section 22 (PCM data) and its sampling frequency (for example, Fc) are stored in the storage section 3. Information about the audio data to be reproduced formerly is rewritten into information about the audio data to be reproduced latterly. For example, when the audio data to be reproduced formerly is DSD data of sampling frequency Fa, and the audio data to be reproduced latterly is DSD data of sampling frequency Fb, information in a state shown in FIG. 4(*a*) is rewritten into information in a state shown in FIG. 4(*b*). Further, for example, when the audio data to be reproduced formerly is DSD data of sampling frequency Fb and the audio data to be reproduced latterly is PCM data of sampling frequency Fc, the information in the state shown in FIG. 4(*b*) is rewritten into information in a state shown in FIG. 4(*c*).

The reproducing section 24 executes reproducing processes such as an equalizing process, a D/A converting process and a volume adjusting process on the data output from the decoding section 22 or the converting section 23, and outputs an audio signal to the speaker 6 or the headphone terminal 7. Further, the reproducing section 24 performs the gapless reproduction for reproducing two audio data sequentially and seamlessly, and the cross-fade reproduction for reproducing two audio data while performing fade-in and fade-out.

An operation of the converting section 23 for converting DSD data into PCM data so as to perform the gapless reproduction is described. When the music reproducing program is activated to firstly convert DSD data into PCM data, the converting section 23 generates the buffer 31 in the storage section 3. The converting section 23 converts the DSD data into PCM data using the buffer 31 generated in the storage section 3. At this time, the converting section 23 stores the sampling frequency of the DSD data converted into the PCM data and information representing that the audio data is the DSD data in the storage section 3 (see FIGS. 4(*a*) and 4(*b*)). When the sampling frequency of the DSD data converted into the PCM data formerly (the sampling frequency stored in the storage section 3) matches with the sampling frequency of the DSD data converted into the PCM data latterly, the converting section 23 converts the DSD data into the PCM data to be reproduced latterly using the buffer 31 used for the conversion into the PCM data to be reproduced formerly. At this time, the converting section 23 stores the sampling frequency of the DSD data converted into the PCM data and information representing that the audio data is the DSD data in the storage section 3 (see FIGS. 4(*a*) and 4(*b*)). Hereinafter, similarly, when the sampling frequency of the DSD data converted into the PCM data formerly matches with the sampling frequency of the DSD data converted into the PCM data latterly, the converting section 23 performs conversion into the PCM data to be reproduced latterly using the buffer 31 used for the conversion into the PCM data to be reproduced formerly.

On the other hand, when the sampling frequency of the DSD data converted into the PCM data formerly (the sampling frequency stored in the storage section 3) is different from the sampling frequency of the DSD data converted into the PCM data latterly, the converting section 23 generates the buffer 32, which is different from the buffer 31 used for the conversion of the PCM data to be reproduced formerly in the storage section 3. The converting section 23 performs the conversion into the PCM data to be reproduced latterly using the generated buffer 32. At this time, the converting section 23 stores the sampling frequency of the DSD data converted into the PCM data and information representing that the audio data is the DSD data in the storage section 3 (see FIGS. 4(*a*) and 4(*b*)). Thereafter, when the sampling frequency of the DSD data converted into the PCM data formerly is different from the sampling frequency of the DSD data converted into the PCM data latterly, the converting section 23 generates a buffer different from the buffer used for the conversion into the PCM data to be reproduced formerly in the storage section 3, and performs the conversion into the PCM data to be reproduced latterly using the generated buffer.

An operation of the converting section 23 for converting DSD data into PCM data so as to perform the cross-fade reproduction is described below. When the music reproducing program is activated to firstly convert DSD data into PCM data, the converting section 23 generates the buffer 31 in the storage section 3. The converting section 23 converts the DSD data into PCM data using the buffer 31 generated in the storage section 3. At this time, the converting section 23 stores the sampling frequency of the DSD data converted into the PCM data and information representing that the audio data is the DSD data in the storage section 3 (see FIGS. 4(*a*) and 4(*b*)). The buffer 32 that is different from the buffer 31 used for the conversion into the PCM data to be reproduced formerly is generated in the storage section 3. The converting section 23 performs the conversion into the PCM data to be reproduced latterly using the generated buffer 32. At this time, the converting section 23 stores the sampling frequency of the DSD data converted into the PCM data and information representing that the audio data is the DSD data in the storage section 3 (see FIGS. 4(*a*) and 4(*b*)). Thereafter, the converting section 23 generates a buffer different from the buffer used for the conversion into the PCM data to be reproduced formerly in the storage section 3, and performs the conversion into PCM data to be reproduced latterly using the generated buffer.

When the audio data to be reproduced is the PCM data, the decoding section 22 decodes the PCM data. At this time, the decoding section 22 stores the sampling frequency of the PCM data and information representing that the audio data is the PCM data in the storage section 3 (see FIG. 4(*c*)).

Figure 5:
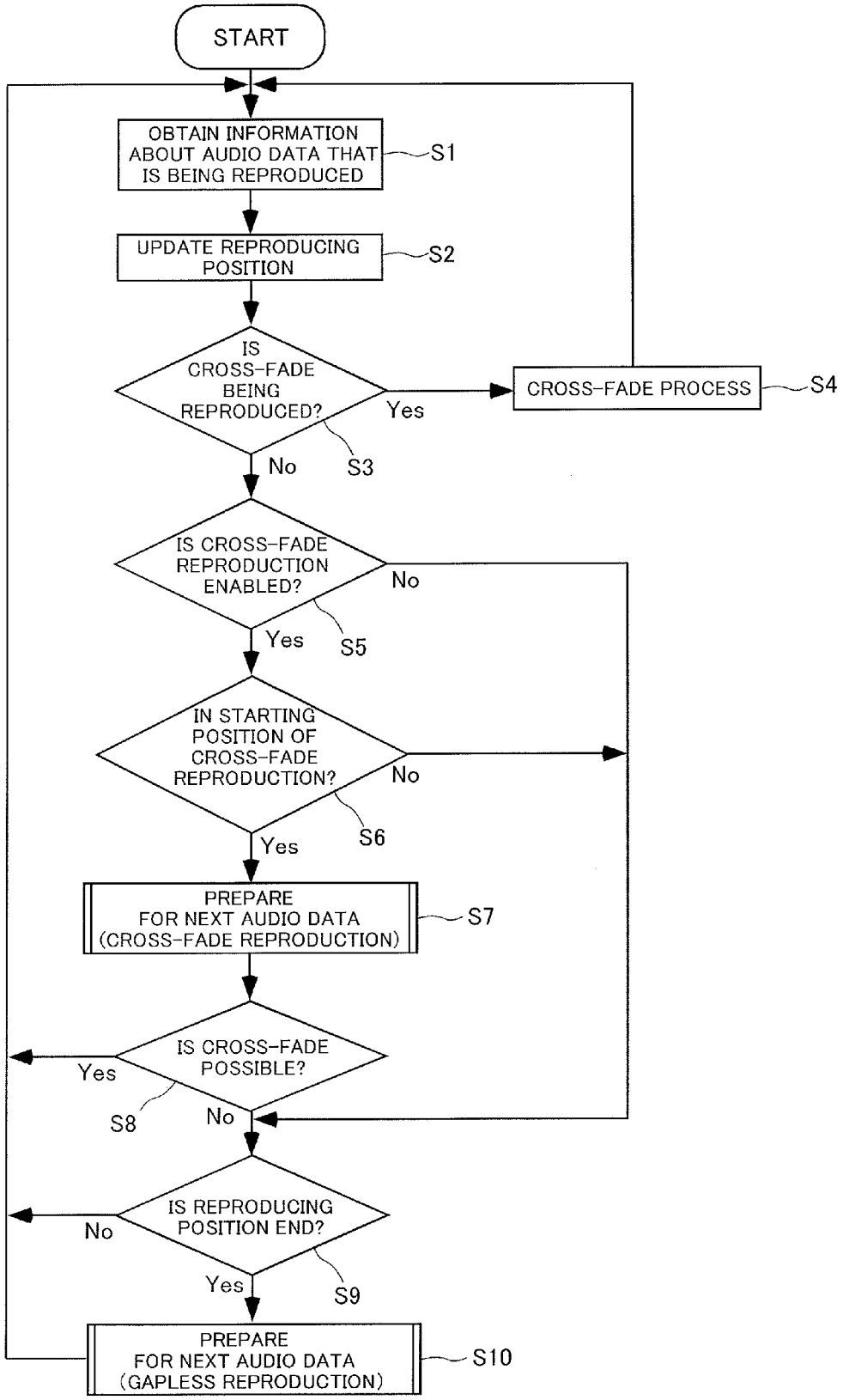
FIG. 5 is a flowchart illustrating a processing operation of the smartphone when a music reproducing program is executed and audio data is reproduced.

Next, a processing operation of the smartphone 1 for reproducing audio data according to the execution of the music reproducing program stored in the storage section 3 is described with reference to a flowchart shown in FIG. 5. At first, the reproducing section 24 obtains information about audio data that is being reproduced (S1). Concretely, the reproducing section 24 obtains the sampling frequency of the audio data (PCM data). The reproducing section 24 obtains a reproducing position of the audio data from the decoding section 22 or the converting section 23, and updates the reproducing position of the audio data into the obtained reproducing position (S2). When PCM data is reproduced, the decoding section 22 decodes the PCM data, and thus the reproducing section 24 obtains the reproducing position of the audio data from the decoding section 22. Further, when DSD data is reproduced, the converting section 23 converts the DSD data into the PCM data, and thus the reproducing section 24 obtains the reproducing position of the audio data from the converting section 23.

The reproducing section 24 determines whether the cross-fade reproduction is performed (S3). When the reproducing section 24 determines that the cross-fade reproduction is performed (S3: Yes), it continues the cross-fade reproduction (S4). When the reproducing section 24 determines that the cross-fade reproduction is not performed (S3: No), it determines whether the cross-fade reproduction is enabled based on settings stored in the storage section 3 (S5). When the reproducing section 24 determines that the cross-fade reproduction is enabled (S5: Yes), it determines whether the reproducing position of the current audio data is within the range of a starting position of the cross-fade reproduction on next audio data based on the reproducing position of the audio data updated at S2 (S6). The starting position of the cross-fade reproduction on next audio data is, for example, 5 seconds before the reproduction end of the reproducing position of the current audio data. When the reproducing section 24 determines that the reproducing position of the current audio data is within the range of the starting position of the cross-fade reproduction on the next audio data (S6: Yes), the reproducing section 24 prepares for the cross-fade reproduction on next audio data (S7). After S7, the reproducing section 24 determines whether the cross-fade reproduction can be performed on the prepared audio data (S8). Concretely, the reproducing section 24 compares the sampling frequency of the audio data obtained at S1 with the sampling frequency of the prepared audio data. When the sampling frequency of the audio data obtained at S1 matches with the sampling frequency of the prepared audio data, the reproducing section 24 determines that the cross-fade reproduction can be performed on the prepared audio data. On the other hand, when the sampling frequency of the audio data obtained at S1 is different from the sampling frequency of the prepared audio data, the reproducing section 24 determines that the cross-fade reproduction cannot be performed on the prepared audio data.

When the reproducing section 24 determines that the cross-fade reproduction can be performed on the prepared audio data (S8: Yes), it executes the process at S1. When the reproducing section 24 determines that the cross-fade reproduction cannot be performed on the prepared audio data (S8: No), or the cross-fade reproduction is not enabled (S5: No), it determines whether the reproducing position of the current audio data is a reproduction end in order to perform the gapless reproduction (S9). When the reproducing section 24 determines that the reproducing position of the current audio data is not the reproduction end (S9: No), it executes the process at S1. When the reproducing section 24 determines that the reproducing position of the current audio data is the reproduction end (S9: Yes), the reproducing section 24 prepares for the gapless reproduction on next audio data (S10). After the process at S10, the reproducing section 24 executes the process at S1.

Figure 6:
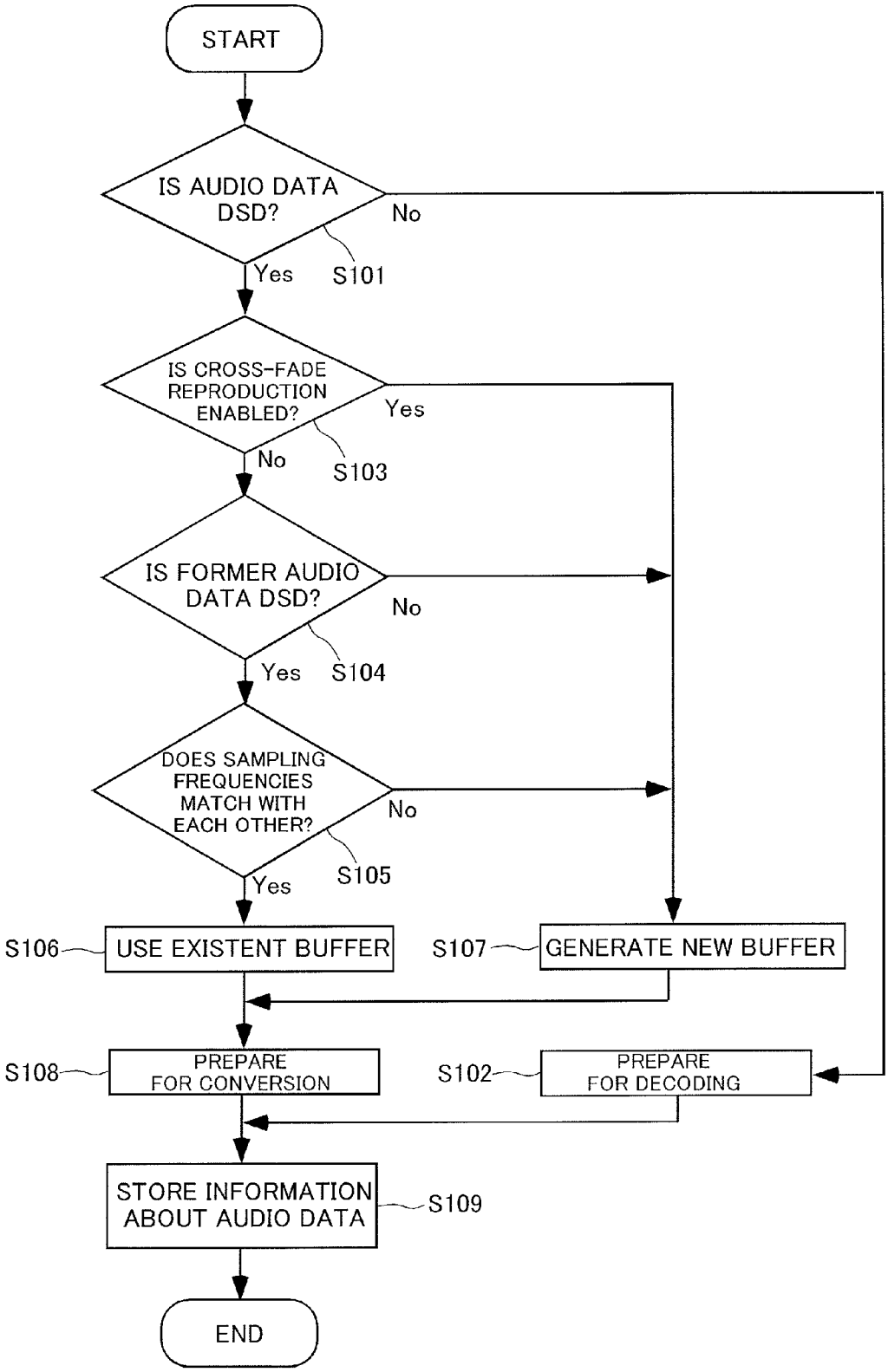
FIG. 6 is a flowchart illustrating the processing operation of the smartphone when an audio data preparing process is executed.

A processing operation of the smartphone 1 for executing the audio data preparing process (S7 and S10 shown in FIG. 5) is described based on the flowchart shown in FIG. 6. At first, the reproducing section 24 determines whether the audio data to be reproduced is DSD data (S101). Concretely, the reproducing section 24 analyzes the audio data to be reproduced so as to obtain information about the audio data. The reproducing section 24 determines whether the audio data to be reproduced is DSD data or PCM data based on the obtained information about the audio data. When the reproducing section 24 determines that the audio data to be reproduced is not DSD data, namely, is PCM data (S101: No), the decoding section 22 prepares for decoding of the PCM data (S102). Concretely, the decoding section 22 executes an initializing process for the decoding of the PCM data.

When the reproducing section 24 determines that the audio data to be reproduced is DSD data (S101: Yes), it determines whether the cross-fade reproduction is enabled based on the settings stored in the storage section 3 (S103). When the reproducing section 24 determines that the cross-fade reproduction is not enabled (S103: No), the reproducing section 24 determines whether audio data to be reproduced formerly is converted from DSD data into PCM data by the converting section 23 (S104). Since the information about the audio data to be reproduced formerly is stored in the storage section 3 as shown in FIG. 4, the reproducing section 24 can determine whether the audio data to be reproduced formerly is converted from DSD data into PCM data by the converting section 23 based on the information stored in the storage section 3.

When the reproducing section 24 determines that the audio data to be reproduced formerly is converted from DSD data into PCM data by the converting section 23 (S104: Yes), the converting section 23 determines whether the sampling frequency of the DSD data converted into the PCM data formerly (the sampling frequency stored in the storage section 3) matches with the sampling frequency of the DSD data to be converted into the PCM data (S105). When the converting section 23 determines that the sampling frequency of the DSD data converted into the PCM data formerly matches with the sampling frequency of the DSD data to be converted into the PCM data (S105: Yes), it prepares for the conversion from the DSD data into PCM data (S108) using the existent buffer (the buffer used for the conversion into the PCM data that is reproduced formerly) (S107).

When the converting section 23 determines that the sampling frequency of the DSD data converted into the PCM data formerly does not match with the sampling frequency of the DSD data to be converted into the PCM data, namely, they are different from each other (S105: No), or the reproducing section 24 determines that the cross-fade reproduction is enabled (S103: Yes), it generates a new buffer in the storage section 3 (S107). That is to say, the converting section 23 generates the buffer different from the buffer used for the conversion into PCM data to be reproduced formerly in the storage section 3. Further, when the reproducing section 24 determines that the audio data to be reproduced formerly is not converted from the DSD data into the PCM data by the converting section 23 (S104: No), the converting section 23 generates a new buffer (S107). This is because the audio data to be reproduced formerly is the PCM data, and thus a buffer is not generated in the storage section 3. The converting section 23 prepares for the conversion from the DSD data into the PCM data using the buffer generated at S107 (S108). After the process at S102, the decoding section 22 stores the information about the audio data in the storage section 3 (S109) (see FIG. 4(*c*)). Further, after the process at S108, the converting section 23 stores the information about the audio data in the storage section 3 (S109) (FIGS. 4(*a*) and 4 (*b*)).

In this embodiment, as described above, when the gapless reproduction is performed, the converting section 23 performs the conversion into the PCM data to be reproduced latterly using the buffer used for the conversion into the PCM data to be reproduced formerly. Therefore, separately from the buffer generated at the time of the conversion into the PCM data to be reproduced formerly, a new buffer is not generated for the conversion into PCM data to be reproduced latterly. For this reason, the generation of noises is repressed between the audio of the audio data to be reproduced formerly and the audio of the audio data to be reproduced latterly at the time of the gapless reproduction. Further, when the cross-fade reproduction is performed, the buffer that is different from the buffer used for the conversion into the PCM data to be reproduced formerly is generated, and the conversion into the PCM data to be reproduced latterly is performed by using the generated buffer. For this reason, in the smartphone 1 that converts audio data into one with different data format so as to reproduce it, the use of single buffer and the generation of a plurality of buffers are switched so that the gapless reproduction and the cross-fade reproduction can be performed in a switching manner.

Further, in this embodiment, when the sampling frequency of the DSD data converted into the PCM data formerly is different from the sampling frequency of the DSD data converted into the PCM data latterly, a buffer that is different from the buffer used for the conversion into the PCM data to be reproduced formerly is generated by the converting section 23 even in the gapless reproduction, and the conversion into the PCM data to be reproduced latterly is performed by using the generated buffer. For this reason, even when the sampling frequencies of the former and latter DSD data are different from each other, the conversion from the DSD data into the PCM data is performed so that the gapless reproduction can be performed.

Further, in this embodiment, when the converting section 23 does not perform the conversion into the PCM data to be reproduced formerly, a buffer is generated even in the gapless reproduction, and the conversion into the PCM data to be reproduced latterly is performed by using the generated buffer. For this reason, even when the conversion into the PCM data to be reproduced formerly is not performed, the DSD data is converted into the PCM data, so that the gapless reproduction can be performed.

The embodiment of the present invention is described above, but the mode to which the present invention is applicable is not limited to the above embodiment and can be suitably varied without departing from the scope of the present invention.

The above embodiment describes the case where the converting section 23 converts DSD data (first audio data) into PCM data (second audio data) having different data format. When audio data (first audio data) of high sampling frequency is converted into audio data (second audio data) of low sampling frequency having different data format (down sampling), the present invention is not limited to the case where DSD data is converted into PCM data.

In the above embodiment, the smartphone 1 is connected to the headphone 100 with wire via the headphone terminal 7. Not limited to this, in a case of a wireless headphone compatible with Bluetooth standards, for example, the smartphone 1 may be wirelessly connected to the headphone via the BT communication section 10.

The above embodiment describes the case where the music reproducing program is installed into the smartphone and the smartphone is made to function as a music reproducing apparatus. Not limited to this, the device that is made to function as the music reproducing apparatus may be a Tablet PC, a feature phone, and a mobile game machine.

The present invention can be suitably employed in the music reproducing apparatus and the music reproducing program for reproducing music.

What is claimed is:

1. A music reproducing apparatus for performing gapless reproduction for reproducing two audio data sequentially and seamlessly and cross-fade reproduction for reproducing two audio data while performing fade-in and fade-out, the apparatus comprising:

a converting section for generating a buffer in a storage section, and converting first audio data into second audio data of different data format using the generated buffer; and a reproducing section for performing the gapless reproduction and the cross-fade reproduction on the second audio data, wherein the converting section performs conversion into the second audio data to be reproduced latterly using the buffer used for the conversion into the second audio data to be reproduced formerly when the reproducing section performs the gapless reproduction, generates a buffer different from the buffer used for the conversion into the second audio data to be reproduced formerly in the storage section, and performs the conversion into the second audio data to be produced latterly using the generated buffer when the reproducing section performs the cross-fade reproduction.

2. The music reproducing apparatus according to claim 1, wherein the converting section stores a sampling frequency of the first audio data converted into the second audio data in the storage section, when the sampling frequency stored in the storage section is different from the sampling frequency of the first audio data converted into the second audio data, generates a buffer that is different from the buffer used for the conversion into the second audio data to be reproduced formerly in the storage section even in a case where the reproducing section performs the gapless reproduction, and performs the conversion into the second audio data to be reproduced latterly using the generated buffer.

3. The music reproducing apparatus according to claim 1, wherein when the converting section does not perform the conversion into the second audio data to be reproduced formerly, the converting section generates a buffer in the storage section even in the case where the reproducing section performs the gapless reproduction, and performs the conversion into the second audio data to be reproduced latterly using the generated buffer.

4. The music reproducing apparatus according to claim 1, wherein the first audio data is DSD data, the second audio data is PCM data.

5. A storage medium in which a music reproducing program is stored, the music reproducing program allows a computer to function as a music reproducing apparatus for performing gapless reproduction for reproducing two audio data sequentially and seamlessly and cross-fade reproduction for reproducing two audio data while performing fade-in and fade-out, the program allowing the computer to function as:

a converting section for generating a buffer in a storage section, and converting first audio data into second audio data of different data format using the generated buffer; and a reproducing section for performing the gapless reproduction and the cross-fade reproduction on the second audio data, the converting section performs conversion into the second audio data to be reproduced latterly using the buffer used for the conversion into the second audio data to be reproduced formerly when the reproducing section performs the gapless reproduction, generates a buffer different from the buffer used for the conversion into the second audio data to be reproduced formerly in the storage section, and performs the conversion into the second audio data to be reproduced latterly using the generated buffer when the reproducing section performs the cross-fade reproduction.

* * * * *